US007716861B2

(12) United States Patent
Stadjuhar, Jr.

(10) Patent No.: US 7,716,861 B2
(45) Date of Patent: May 18, 2010

(54) OUTDOOR DISPLAY SIGN

(75) Inventor: Robert Charles Stadjuhar, Jr., Woodland Park, CO (US)

(73) Assignee: Skyline Products, Inc., Colorado Springs, CO (US)

( * ) Notice: Subject to any disclaimer, the term of this patent is extended or adjusted under 35 U.S.C. 154(b) by 58 days.

(21) Appl. No.: 11/605,681

(22) Filed: Nov. 28, 2006

(65) Prior Publication Data

US 2008/0120880 A1 May 29, 2008

(51) Int. Cl.

| | |
|---|---|
| ***G09F 13/04*** | (2006.01) |
| ***G09F 13/00*** | (2006.01) |
| ***G09F 7/00*** | (2006.01) |
| ***G09F 15/00*** | (2006.01) |
| ***G08G 1/095*** | (2006.01) |
| ***F21V 13/00*** | (2006.01) |
| ***F21V 11/00*** | (2006.01) |

(52) U.S. Cl. ..... 40/564; 40/554; 40/612; 40/624; 340/944; 362/242; 362/351; D26/118

(58) Field of Classification Search ..... 40/564, 40/554, 612, 624; D26/118; 362/242, 351; 340/944

See application file for complete search history.

(56) References Cited

U.S. PATENT DOCUMENTS

| | | | | |
|---|---|---|---|---|
| 4,435,696 | A * | 3/1984 | Gould et al. | 340/944 |
| 5,396,724 | A * | 3/1995 | Dinsmore | 40/612 |
| 5,654,705 | A * | 8/1997 | Houten et al. | 340/944 |
| 6,750,829 | B2 * | 6/2004 | Luoma et al. | 345/1.1 |
| 7,180,428 | B1 * | 2/2007 | LeVan et al. | 340/936 |
| 7,231,735 | B2 * | 6/2007 | Gelbert | 40/541 |

* cited by examiner

*Primary Examiner*—Lesley Morris
*Assistant Examiner*—Syed A Islam

(57) ABSTRACT

An outdoor display sign has a display enclosure. The display enclosure has a number shades that reduce the solar loading on the display enclosure. The outdoor display sign has shades covering the top, back, sides and parts of the front of the sign. The shades are offset from the display enclosure to allow natural airflow between the shade and the display enclosure.

11 Claims, 4 Drawing Sheets

OUTDOOR DISPLAY SIGN

RELATED APPLICATIONS

None

FIELD OF THE INVENTION

The present invention relates generally to the field of signs and more particularly to an outdoor display sign.

BACKGROUND OF THE INVENTION

Outdoor variable message signs are used to provide information to motorists. One example of these signs are the variable message signs used by highway departments to tell motorists, what lanes are open and short messages such as accident ahead. It is the goal of highway departments to provide motorist with more information on the state of the highway ahead. Variable message signs require controllers, drivers, and a number of environmental control systems. These environmental control systems include filters that have to be replaced, fans to blow air through the sign and in some cases air conditioners. This increases the cost of variable message signs and limits the number of places that these signs are utilized.

Thus there exists a need for a simpler, less expensive outdoor variable message sign.

SUMMARY OF INVENTION

An outdoor display sign that overcomes these and other problems has a display enclosure. The display enclosure has a number shades that reduce the solar loading on the display enclosure. The outdoor display sign has shades covering the top, back, sides and parts of the front of the sign. The shades may be offset from the display enclosure to allow natural airflow between the shade and the display enclosure. In one embodiment, the display enclosure is completely sealed and does not have any environmental control equipment. This is because the shades provide adequate shading of the sun so that no environmental control equipment is required. Occasionally, the sealed display enclosure has a detached controller and/or power supplies. In one embodiment, the display enclosures are modular and may be used to build a larger sign out of a number of one line modules. The sign may have a mask that provides contrast enhancement for the display and provides additional protection from solar loading when the sun is low in the sky.

DETAILED DESCRIPTION OF THE DRAWINGS

The present invention is directed to an outdoor variable message display sign that is inexpensive to build and maintain. A key to building an inexpensive variable message sign was to eliminate the need for an active cooling system. These outdoor variable message signs use LEDs (Light Emitting Diodes) or other electrical/electronic light sources. When these light sources and their associated electronics get too hot it reduces their lifetime. The outdoor variable message display sign described herein keeps the electronics cool using a passive system of shades. The electronics and lights are placed in a display enclosure. The display enclosure has shades that block the light from hitting the top, back, sides and front of the display enclosure. The shade facing north may be eliminated because the sun will not shine on the north side of the sign in the northern hemisphere. Of course the opposite is true in the southern hemisphere. Since the sun's solar loading is the biggest factor effecting the internal temperature of a sign, using the shades allows a display to have no active cooling or at least significantly reduces the cooling system requirements. The structure to hold the shades may be designed so that air may freely travel between the display enclosure and the shades. This allows natural breezes to cool the display enclosure and associated electronics and allows for natural convention to pull cool air past the display enclosure. As a result, of this passive cooling system the outdoor display sign is easier and less expensive to build than actively cooled signs. In addition, the sign may have a mask that provides contrast enhancement for the display and provides additional protection from solar loading when the sun is low in the sky.

Figure 1:
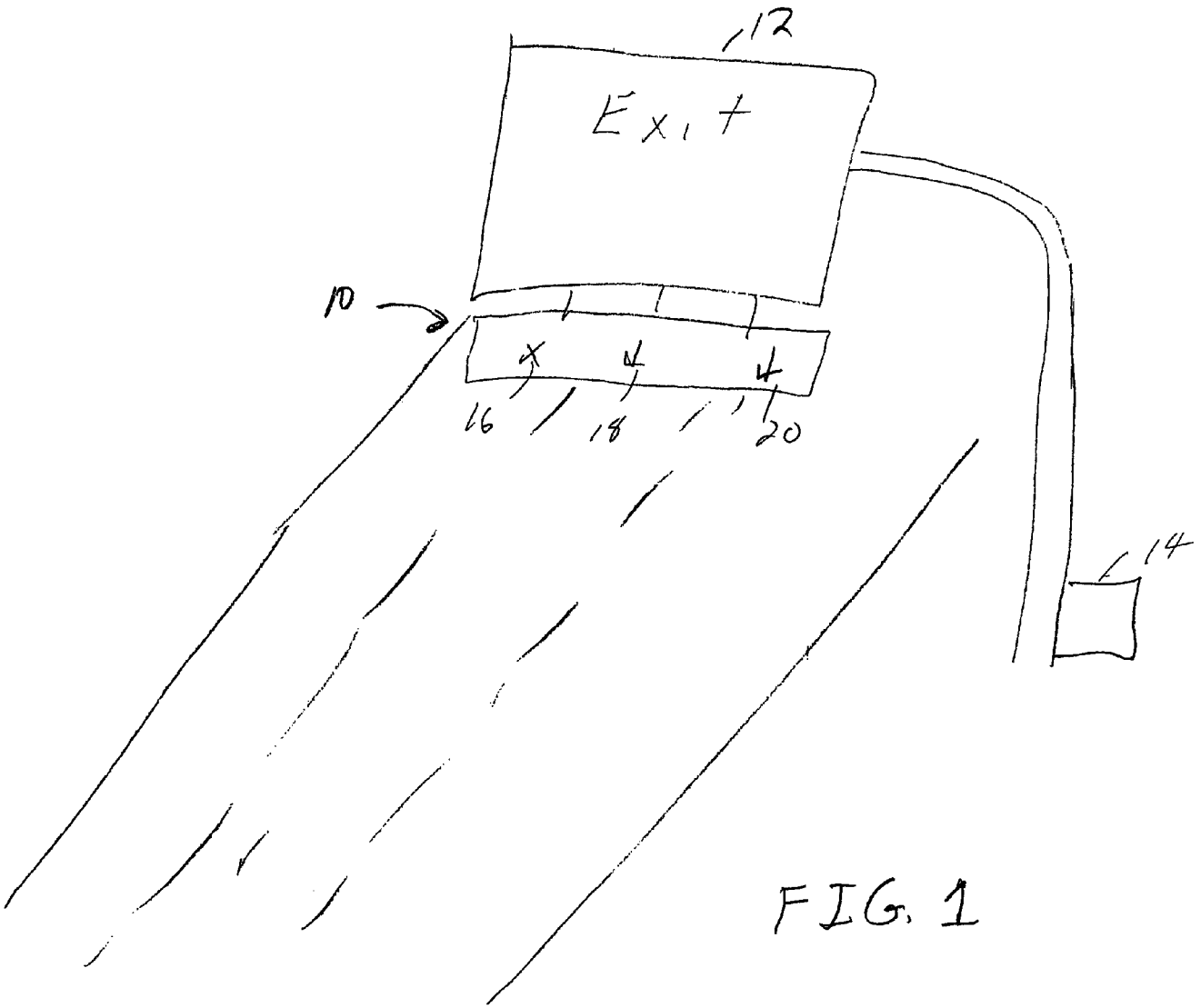
FIG. 1 is a perspective drawing of an outdoor display sign in use on a highway in accordance with one embodiment of the invention.

FIG. 1 is a perspective drawing of an outdoor display sign 10 in use on a highway in accordance with one embodiment of the invention. The sign 10 in this case is mounted below a standard static highway sign 12. The outdoor display sign 10 has a controller 14 which may be pole mounted or may be on the ground. The controller 14 is in communication with the sign 10 and directs the sign to display various messages 16, 18, 20. In this case the sign 10 is a one line sign and is just displaying an "X" 16 for a closed lane and an arrow 18 & 20 for an open lane.

Figure 2:
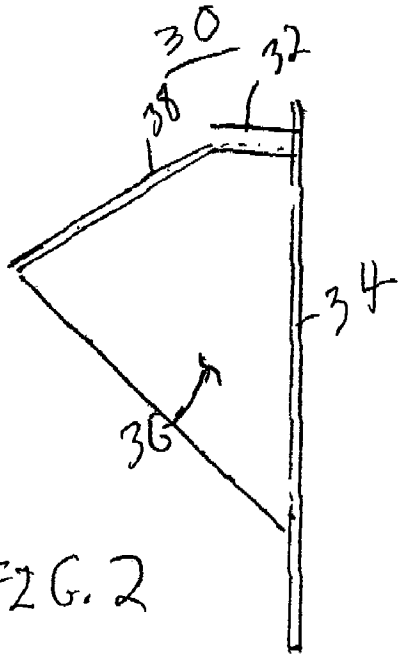
FIG. 2 is a side view of an outdoor display sign in accordance with one embodiment of the invention.

FIG. 2 is a side view of an outdoor display sign 30 in accordance with one embodiment of the invention. It is important to note that the invention is directed to electronic signs where cooling is an issue due to solar loading. This view shows that the sign enclosure (shown in FIG. 3) is shaded by a top shade 32, back shade 34, side shade 36 and front shade 38. The shades 32, 34, 36, 38 form a shade system that block direct sunlight from impinging on the display enclosure except on the face of the display enclosure when the sun is low in the sky. "Low in the sky" can be defined as only 25 degrees above the horizon or lower.

Figure 3:
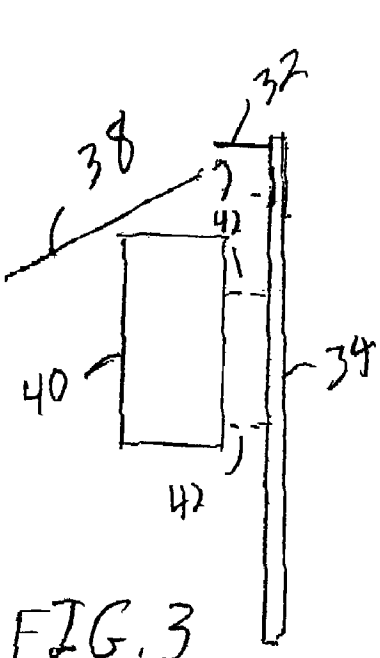
FIG. 3 is a cross section of an outdoor display sign in accordance with one embodiment of the invention.

FIG. 3 is a cross section of an outdoor display sign 30 in accordance with one embodiment of the invention. The sign 30 contains a display enclosure 40. The display enclosure 40 holds the electronic/electric light sources and associated drive electronics. In one embodiment, the display enclosure 40 is completely sealed. This means that essentially no air or water enters or leaves the display enclosure 40. In addition, it means that the light sources are enclosed in the display enclosure. In one embodiment, the display enclosure 40 has a transparent glazing in front of the light sources. A mask (see FIG. 7) may be used to further reduce the solar loading when the sun is low in the sky and impinging on the front of the sign. The display enclosure 40 is mounted to a back mounting plate 34, which acts as a back shade. The support members 42 are shown as dashed lines. The support members 42 do not significantly impede the airflow between the back of the display enclosure 32 and the mounting plate 34. A top shade 32 is mounted to the mounting plate 34. The top shade 32 is offset from the top of the display enclosure 40 and keeps the sunlight from directly hitting the top of the display enclosure 40. A display shade 38 is offset from the display enclosure 40 and is coupled to the mounting plate 34 by supports 42. Again the supports do not extend the length of the display enclosure 40 and therefore do not impede the airflow between the shades 32, 34, 38 and display enclosure 40 or between the display enclosure 40 and the mounting plate 34. Note that the display shade 38 is sloping instead of horizontal to shed snow. In environments that do not have snow, the front shade 38 may be horizontal instead of sloping.

Figure 4:
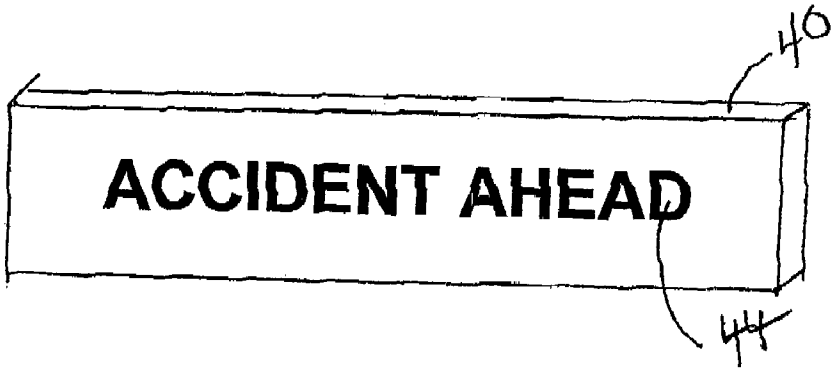
FIG. 4 is a perspective view of a display enclosure in accordance with one embodiment of the invention.

FIG. 4 is a perspective view of a display enclosure 40 in accordance with one embodiment of the invention. In this case the display enclosure 40 is a single line display. Commonly, the display enclosure 40 has a plurality of LEDs (Light Emitting Diodes) that are used to form the display "Accident Ahead" 44. Note that the display 44 is considered the front of the display enclosure. In one embodiment, the display enclosure 40 is sealed. This means that the display enclosure 40 does not allow exchange of water, dirt or air between the interior of the enclosure and the exterior of the enclosure.

Figures 5, 6:
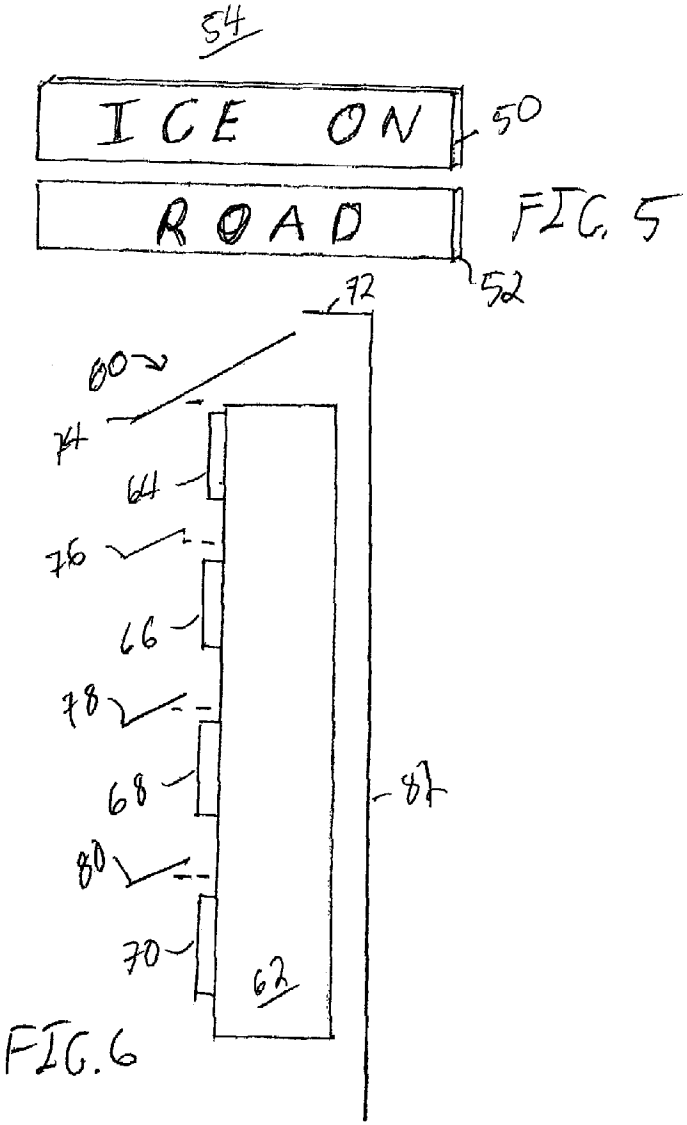
FIG. 5 is a perspective view of the modular nature of a display enclosure in accordance with one embodiment of the invention.
FIG. 6 is a cross section of an outdoor display sign in accordance with one embodiment of the invention.

FIG. 5 is a perspective view of the modular nature of a display enclosure in accordance with one embodiment of the invention. A pair of display enclosures 50 & 52 are placed next to each other to form a coherent single display 54. Each of the display enclosures 50 & 52 are controlled by a single controller to form the display "ICE ON ROAD." Note that the display enclosure can also be placed side by side to form a long horizontal sign.

FIG. 6 is a side view of an outdoor display sign 60 in accordance with one embodiment of the invention. This sign 60 is a multi-line display. The display enclosure 62 has four lines 64, 66, 68, 70 of display. The sign 60 has a top shade 72 and a number of display shades 74, 76, 78, 80 and has a back shade 82. Note that the display sign 60 may also have side shades similar to that shown in FIG. 2. The display shades 76, 78, 80 are positioned between the display lines 64, 66, 68, 70 of the display. The shades 72, 74, 76, 78, 80 are offset from the display enclosure 62 and held in place by structural supports. This shading reduces or eliminates the need for active cooling systems.

Computer simulations have shown that the single line variable message display sign similar to the one in FIGS. 2 & 3 will actually have lower temperatures for the control electronics in most cases than actively cooled signs.

Figure 7:
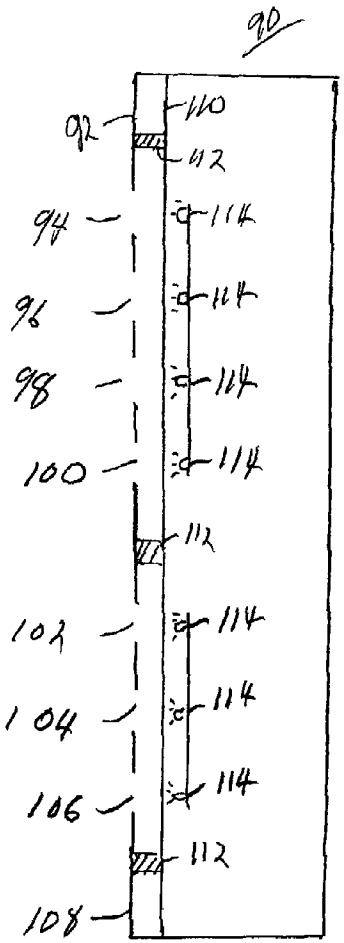
FIG. 7 is a cross section of a display enclosure showing a mask in accordance with one embodiment of the invention.

FIG. 7 is a cross section of a display enclosure 90 showing a mask 92 in accordance with one embodiment of the invention. The mask 92 has a number of holes 94, 96, 98, 100, 102, 104, 106 that are generally circular. The front 108 of the mask 92 is a mat black which enhances the contrast ratio of the sign 90. The mask 92 is held to a glazing 110 by insulating foam adhesive strips 112. The adhesive strips 112 hold the mask 92 offset from the glazing 110. As a result, air can flow between the holes 94, 96, 98, 100 and 102, 104, 106. The air flow between the holes helps to keep the sign enclosure 90 cool. In addition, the offset prevents thermal conduction from the mask to the glazing 110. The holes 94, 96, 98, 100, 102, 104, 106 are aligned with the display elements 114. Thus, there has been described an outdoor variable message sign that provides maximum protection from solar loading. As a result, the sign enclosure generally does not require active cooling systems.

While the invention has been described in conjunction with specific embodiments thereof, it is evident that many alterations, modifications, and variations will be apparent to those skilled in the art in light of the foregoing description. Accordingly, it is intended to embrace all such alterations, modifications, and variations in the appended claims.

What is claimed is:

1. An outdoor display sign, comprising:

a display enclosure for large permanent highway signs;

a variable message display forming a part of a face of the display enclosure; and a shade system blocking direct sunlight from impinging on the display enclosure except for a front face of the display enclosure when the sun is low in the sky, the shade system having a top shade offset from and covering a top of the display enclosure, wherein the offset of the top shade allows air to travel freely between the display enclosure and the top shade, the top shade is angled at less than a ninety degree angle from the face of the variable message sign, wherein the shade system has a display shade extending from a front side of the display enclosure, wherein the display enclosure includes a mask on the face of the sign and the mask is thermally isolated from the display enclosure and the mask is offset form the display enclosure, wherein the sign is protected from solar loading and does not require an active cooling system.

2. The sign of claim 1, wherein the display enclosure is sealed.

3. The sign of claim 1, wherein the shade system includes a top shade that is offset from the display enclosure.

4. The sign of claim 1, wherein the shade system includes a front shade that is offset from the display enclosure.

5. The sign of claim 1, wherein the shade system includes a back shade that is offset from the display enclosure.

6. The sign of claim 1, wherein the shade system includes a side shade that is offset from the display enclosure.

7. The sign of claim 1, wherein the front shade is at an angle to the face of the display enclosure.

8. The sign of claim 1, wherein the sign enclosures are modular.

9. An outdoor display sign, comprising:

a sealed display enclosure for large highway signs;

a variable message display forming a part of a face of the display enclosure;

a shade offset from and extending out from a face of the display enclosure; and a top shade offset from and covering a top of the display enclosure, wherein the offset of the top shade allows air to travel freely between the display enclosure and the top shade, the top shade is angled at less than a ninety degree angle from the face of the variable message sign, a second shade offset from the face of the display enclosure and extends out at an angle from the display enclosure; and a back shade wherein the sign is protected from solar loading and does not require an active cooling system.

10. The sign of claim 9, wherein the display enclosure is modular.

11. The sign of claim 9, further including a side shade.

* * * * *